US011629567B2

(12) United States Patent
Jackson et al.

(10) Patent No.: US 11,629,567 B2
(45) Date of Patent: Apr. 18, 2023

(54) FRAC DART WITH A COUNTING SYSTEM

(71) Applicants: Todd Christopher Jackson, Houston, TX (US); Matthew D. Solfronk, Houston, TX (US); James Scott Sanchez, Spring, TX (US)

(72) Inventors: Todd Christopher Jackson, Houston, TX (US); Matthew D. Solfronk, Houston, TX (US); James Scott Sanchez, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 50 days.

(21) Appl. No.: 17/338,782

(22) Filed: Jun. 4, 2021

(65) Prior Publication Data

US 2022/0389779 A1 Dec. 8, 2022

(51) Int. Cl.

| | |
|---|---|
| ***E21B 23/04*** | (2006.01) |
| ***E21B 34/14*** | (2006.01) |
| ***E21B 29/00*** | (2006.01) |
| ***E21B 33/08*** | (2006.01) |

(52) U.S. Cl.

CPC ..... *E21B 23/0413* (2020.05); *E21B 29/00* (2013.01); *E21B 33/08* (2013.01); *E21B 34/142* (2020.05); *E21B 2200/06* (2020.05)

(58) Field of Classification Search

CPC .... E21B 34/142; E21B 2200/06; E21B 29/00; E21B 23/0413; E21B 33/08

See application file for complete search history.

(56) References Cited

U.S. PATENT DOCUMENTS

| | | | | |
|---|---|---|---|---|
| 3,263,752 | A * | 8/1966 | Conrad | E21B 34/14 166/318 |
| 8,276,674 | B2 * | 10/2012 | Lopez de Cardenas | E21B 43/08 166/334.4 |
| 2010/0282338 | A1 | 11/2010 | Gerrard et al. | |
| 2011/0056692 | A1 | 3/2011 | Lopez De Cardenas et al. | |
| 2013/0206402 | A1 | 8/2013 | Coon | |
| 2015/0260013 | A1 * | 9/2015 | Booker | E21B 34/066 340/853.3 |
| 2016/0084075 | A1 * | 3/2016 | Ingraham | E21B 23/01 166/53 |

FOREIGN PATENT DOCUMENTS

WO 2011146866 A2 11/2011

OTHER PUBLICATIONS

International Search Report and Written Opinion for International Application No. PCT/US2022/031920; International Filing Date Jun. 2, 2022; dated Sep. 6, 2022 (pp. 1-8).

* cited by examiner

*Primary Examiner* — D. Andrews
(74) *Attorney, Agent, or Firm* — Cantor Colburn LLP

(57) ABSTRACT

A frac dart includes a body having an outer surface and an end including at least one opening. A cutter support is mounted at the end adjacent the at least one opening. A cutter is moveably mounted at the cutter support. A counter support is slideably mounted on the outer surface, and a counter is arranged between the counter support and the cutter support. The cutter is operable to sever a portion of the counter.

19 Claims, 10 Drawing Sheets

FRAC DART WITH A COUNTING SYSTEM

BACKGROUND

In the resource recovery industry, often times objects such as balls, darts, and the like, are dropped into a string. The object lands on a seat and may close off a flow path. Pressure may be applied in the string to activate one or more components. For example, the pressure may be employed to set an anchor, shift a piston to open a screen, open a valve or the like. I many cases, multiple objects are dropped into the string. Each object is used to activate a corresponding downhole device.

When dropping multiple objects, size can be a concern. The first object dropped may have a first size, and the second object dropped may have a second, smaller size. In this way, the first object may pass through multiple object seats along the string. By the same token, when constructing the string, the object seats are installed in a selected order so as to accommodate multiple objects. If a seat is out of order, or an object is dropped out of sequence, a portion of the wellbore may be temporarily unreachable.

If and when portions of the wellbore become temporarily unreachable operators may try to force the object ball through an incorrectly sized seat, degrade the object or, remove portions of the string, take out the object, and start over. In all cases, production delays will result. Delays in production are extremely costly. Accordingly, the industry would welcome a solution that simplifies object introduction into a wellbore.

SUMMARY

Disclosed is a frac dart includes a body having an outer surface and an end including at least one opening. A cutter support is mounted at the end adjacent the at least one opening. A cutter is moveably mounted at the cutter support. A counter support is slideably mounted on the outer surface, and a counter is arranged between the counter support and the cutter support. The cutter is operable to sever a portion of the counter.

Also disclosed is a resource exploration and recovery system including a surface system and a sub-surface system including a tubular extending into a formation. The tubular includes a plurality of frac sleeves and a frac dart that may selectively pass through one or more of the plurality of frac sleeves. The frac dart includes a body having an outer surface and an end including at least one opening, a cutter support mounted at the end at the at least one opening, a cutter moveably mounted at the cutter support, a counter support slideably mounted on the outer surface, and a counter arranged between the counter support and the cutter support, the cutter being operable to sever a portion of the counter.

Still further disclosed is a method of introducing a frac dart having a sleeve counting system into a tubular including dropping the frac dart into the tubular, counting, with the sleeve counting system, each time the frac dart passes through a frac sleeve for a selected number of frac sleeves, and preventing the frac dart from passing through a selected frac sleeve immediately after the selected number of frac sleeves.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
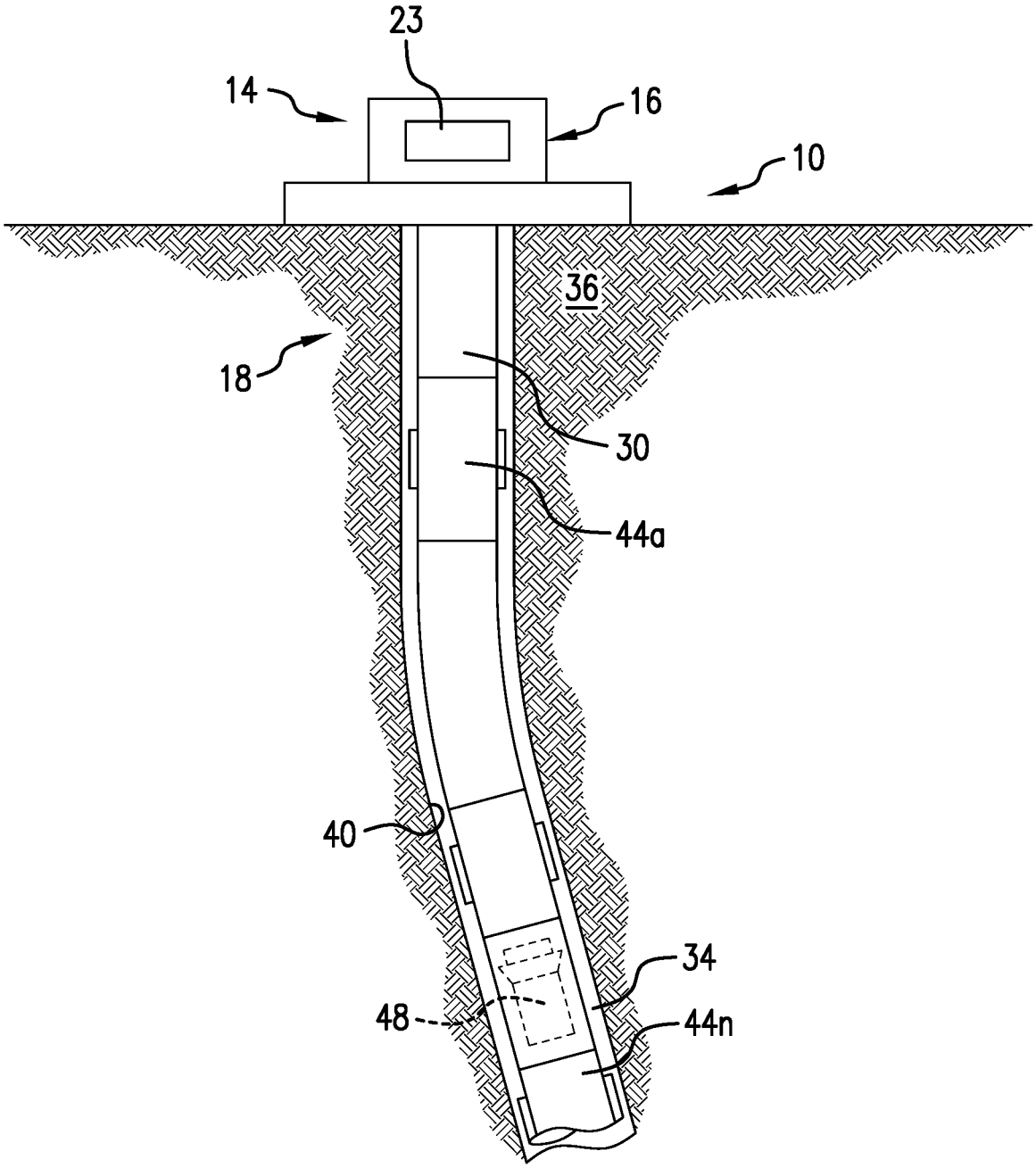
FIG. 1 depicts a resource exploration and recovery system including a frac dart having a counting system, in accordance with a non-limiting example.

A resource exploration and recovery system, in accordance with a non-limiting example, is indicated generally at 10, in FIG. 1. Resource exploration and recovery system 10 should be understood to support well drilling operations, completions, resource extraction and recovery, $CO_2$ sequestration, and/or the like. Resource exploration and recovery system 10 may include a first system 14 which, in some environments, may take the form of a surface system 16 operatively and fluidically connected to a second system 18 which, in some environments, may take the form of a subsurface or downhole system (not separately labeled).

First system 14 may include a control system 23 that may provide power to, monitor, communicate with, and/or activate one or more downhole operations. Surface system 16 may include additional systems such as pumps, fluid storage systems, cranes, and the like (not shown). Second system 18 may include a tubular sting 30 formed from one or more tubulars (not separately labeled) that extends into a wellbore 34 formed in a formation 36. Wellbore 34 includes an annular wall 40 which may be defined by a surface of formation 36.

Figure 2:
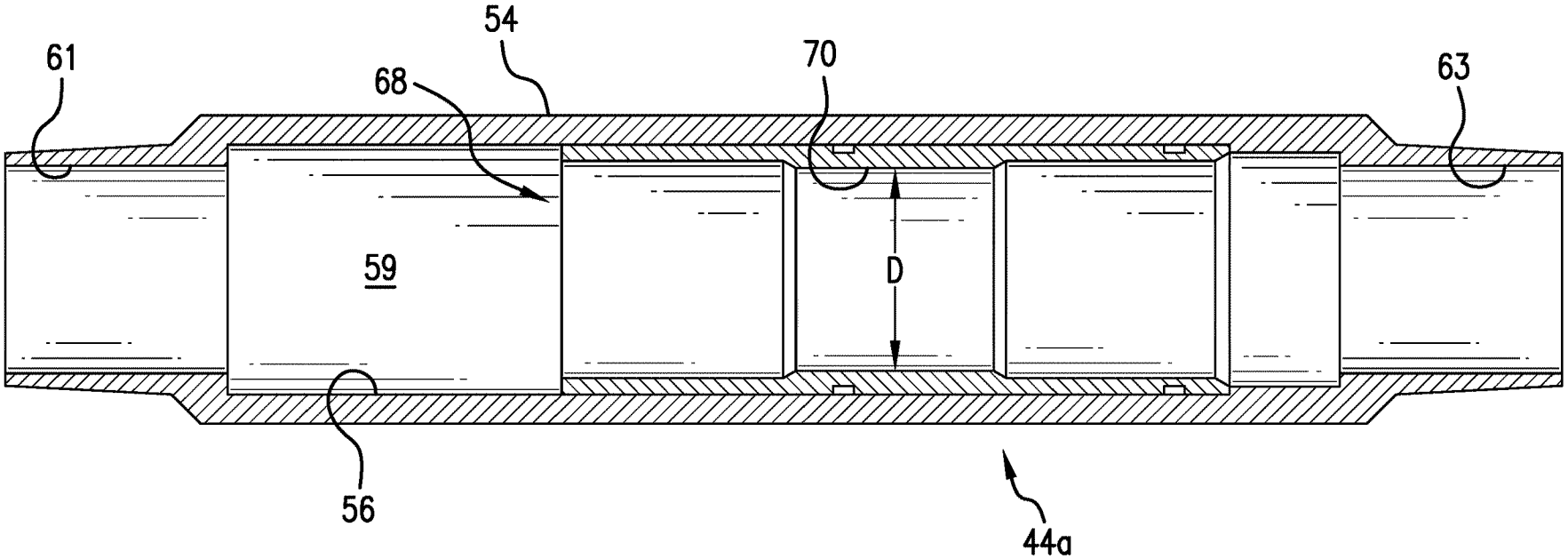
FIG. 2 depicts a cross-sectional view of a frac sleeve, in accordance with a non-limiting example.

In a non-limiting example, tubular string 30 includes a plurality of frac sleeves 44*a-n* that may receive a frac dart 48. Reference will follow to FIG. 2 in describing frac sleeve 44*a* with an understanding that each frac sleeve 44*a*-4*n* includes similar structure and is similarly dimensioned. Frac sleeve 44*a* includes an outer surface 54 and an inner surface 56 that defines a passage portion 59. Frac sleeve 44*a* includes an inlet 61 and an outlet 63. A sleeve member 68 is arranged in passage portion 59 and secured to inner surface 56 between inlet 61 and outlet 63. Sleeve member 68 defines an annular tubular restriction 70. That is, annular restriction includes a first diameter (D1) and passage portion 59 includes a second diameter (D2) that is larger than the first diameter. The first and second diameters in each frac sleeve 44*a*-44*n* are substantially identical.

Figure 3:
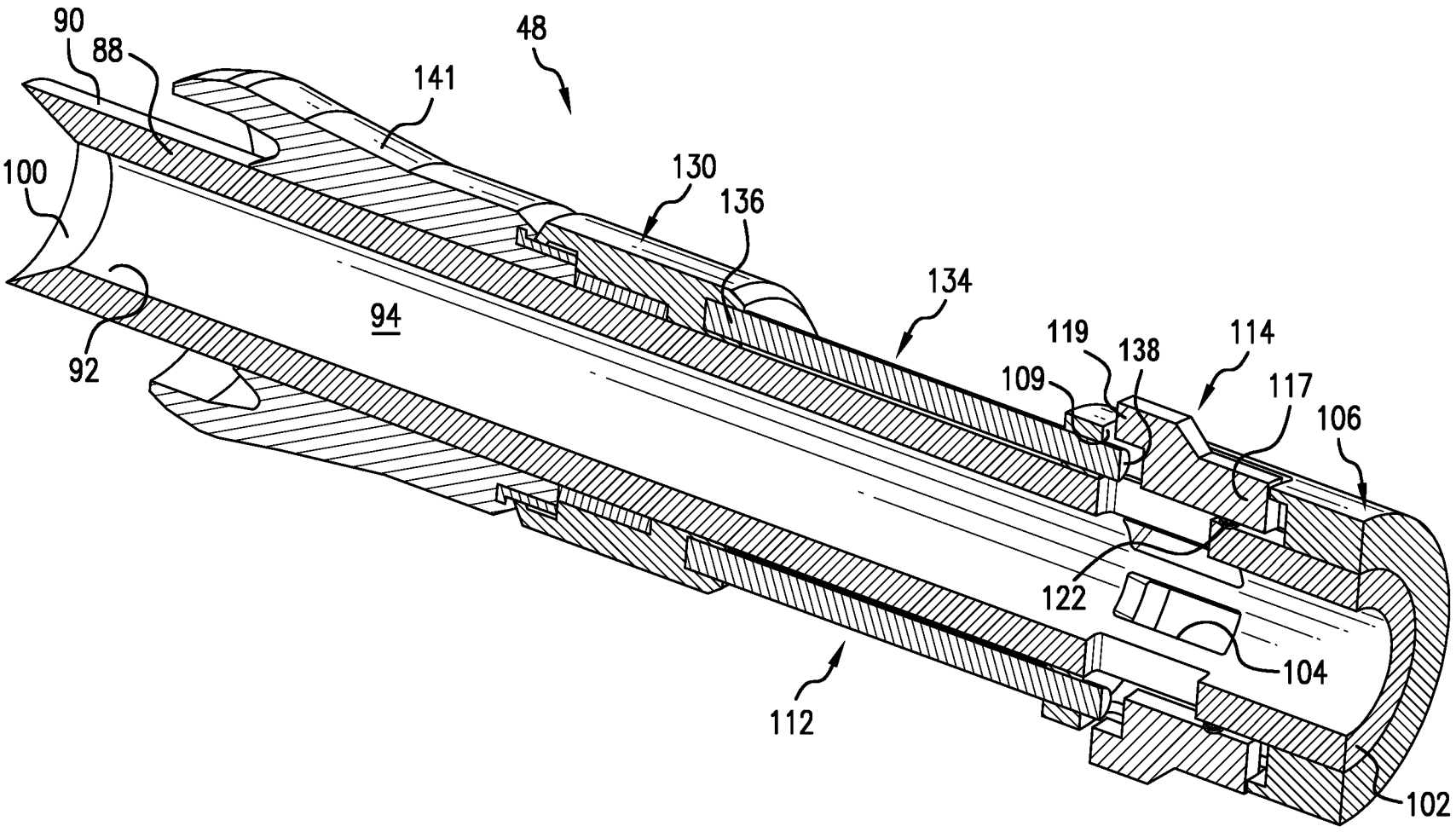
FIG. 3 depicts a cross-sectional view of the frac dart of FIG. 1, in accordance with a non-limiting example.

Reference will now follow to FIG. 3 in describing frac dart 48 in accordance with a non-limiting example. In a non-limiting example, frac dart 48 includes a body 88 having an outer surface 90 and an inner surface 92 defining a passage 94. At this point, it should be understood, that while shown as including a passage, other examples may include a substantially solid cross-section. Body 88 includes a first end 100 and a second end 102. A plurality of openings 104 are arranged at second end 102. A cutter support 106 is mounted at second end 102. Cutter support 106 includes a plurality of cutter openings 109 that register with or are aligned with openings 104 in body 88. As will be detailed more fully herein, frac dart 48 includes a sleeve counting system 112 that counts each frac sleeve 44*a-n* that is passed by frac dart 48. That is, each time frac dart 48 passes through a restriction 70, a count is registered. At a selected count, the frac dart 48 lands and formed an impediment to flow.

In accordance with a non-limiting example, counting system 112 includes a plurality of cutters, one of which is indicated at 114 that pivot relative t cutter support 106 each time they are acted upon by a restriction 70. Cutter 114 includes a first portion 117 pivotally mounted to cutter support 106 and a second portion 119 that projects outwardly from body 88 so as to be engaged by restriction 70. A spring 122 may be employed to radially outwardly bias cutter 114.

In a non-limiting example, counting system 112 also includes a counter support 130 and a selectively frangible counter shown in the form of a rod 134. Rod 134 is sized to be severed a select number of times. That is, each time frac dart 48 passes through a restriction 70, a portion of rod 134 is removed. Once rod reaches a selected length, cutter 144 will be prevented from deflecting inwardly causing frac dart 48 to become landed at a selected frac sleeve 44*a-n*. In a non-limiting example, each rod 134 includes a first end section 136 and an opposing second end section 138. The particular location of second end section 138 changes each time cutter 114 is pivoted.

Figure 4A:
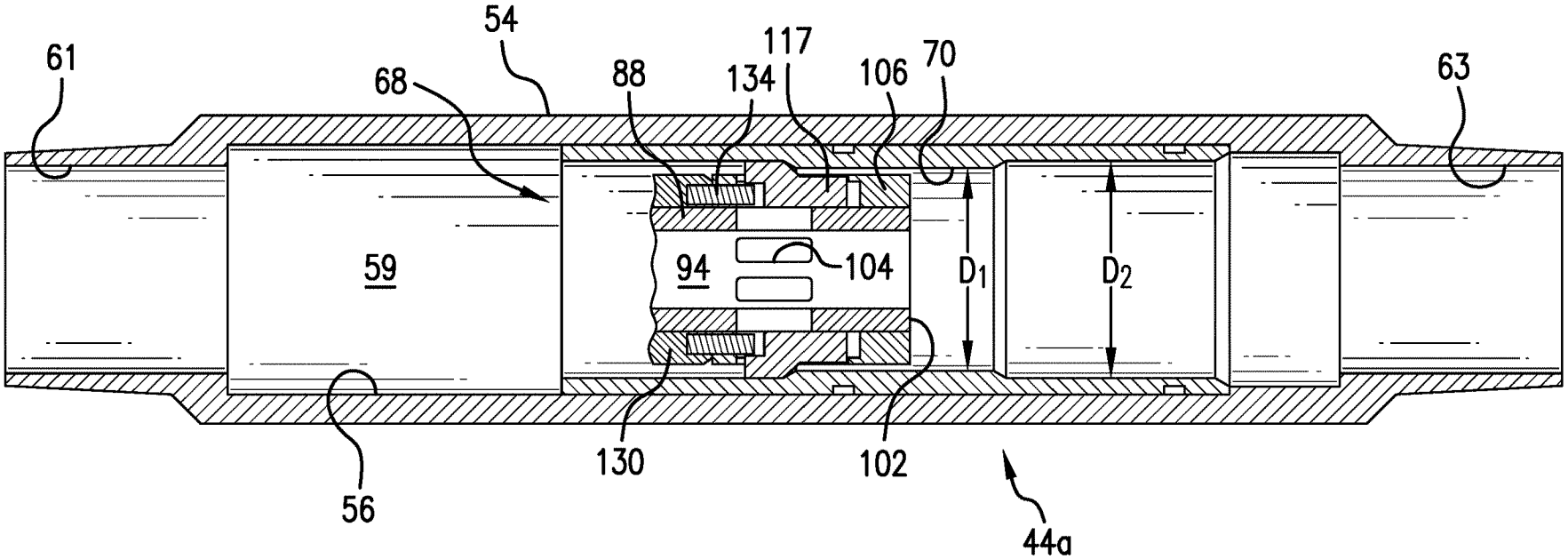
FIG. 4A depicts a cross-sectional view of a counting portion of the frac dart of FIG. 2 entering a frac sleeve, in accordance with a non-limiting example.
Figure 4B:
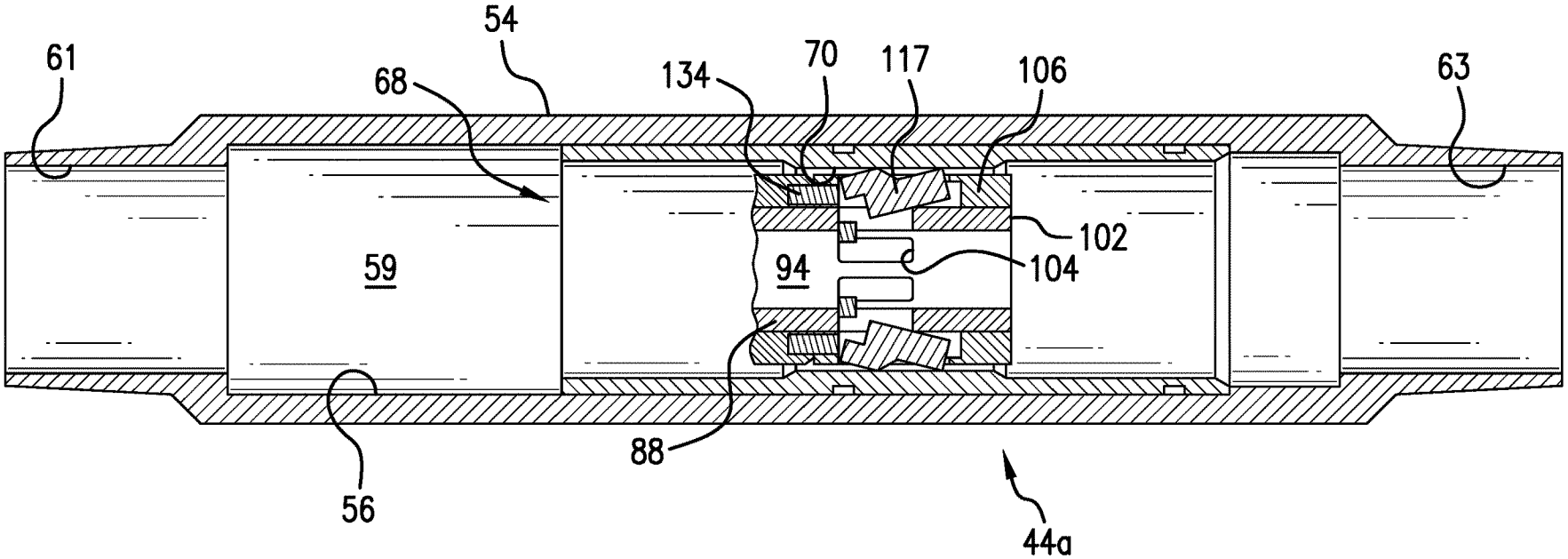
FIG. 4B depicts a cross-sectional view of the counting portion of the frac dart of FIG. 4A in the frac sleeve, in accordance with a non-limiting example
Figure 4C:
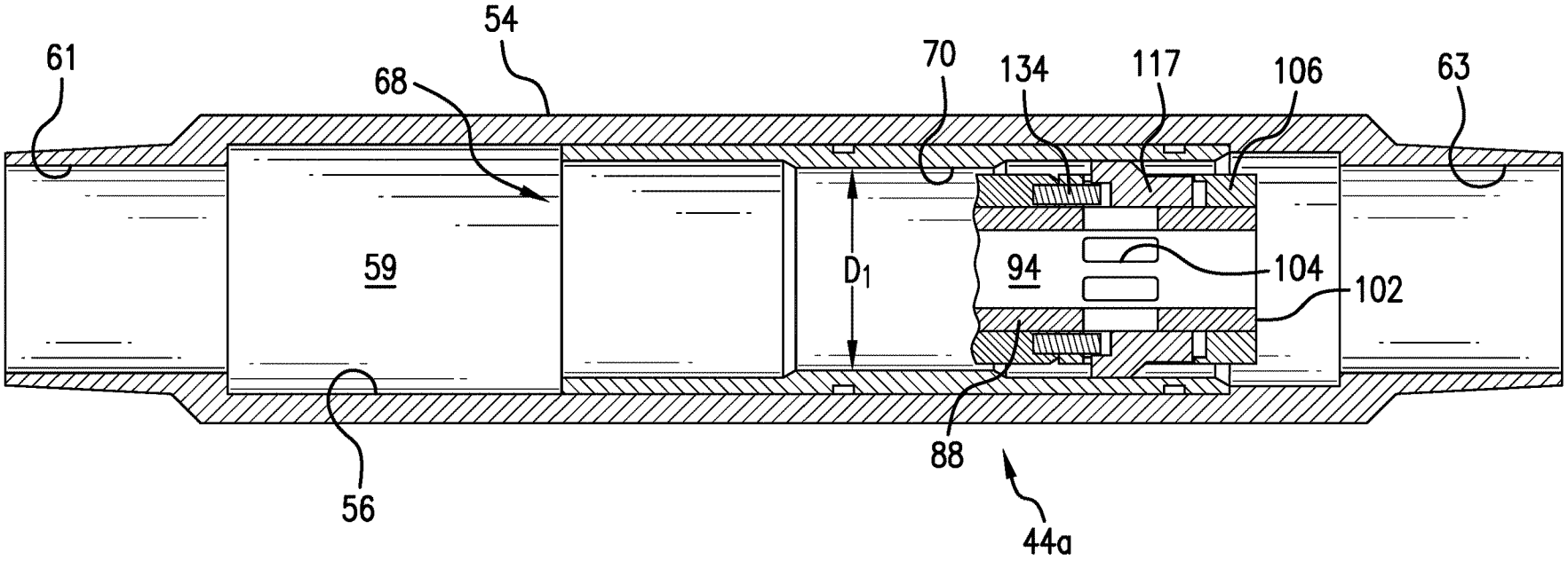
FIG. 4C depicts a cross-sectional view of the counting portion of the frac dart of FIG. 4B passing through the frac sleeve, in accordance with a non-limiting example.
Figure 5A:
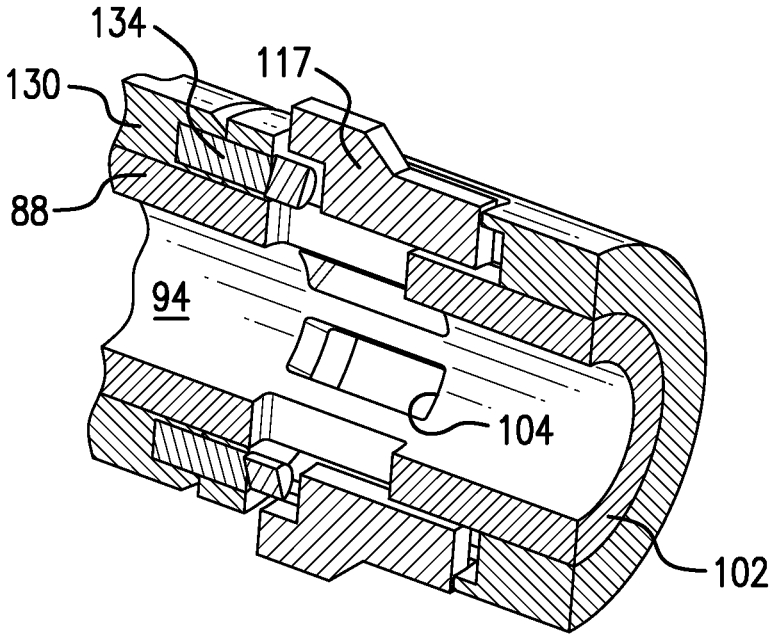
FIG. 5A depicts a partial cross-sectional view of the frac dart of FIG. 4A showing the counting portion in a first position, in accordance with a non-limiting example.
Figure 5B:
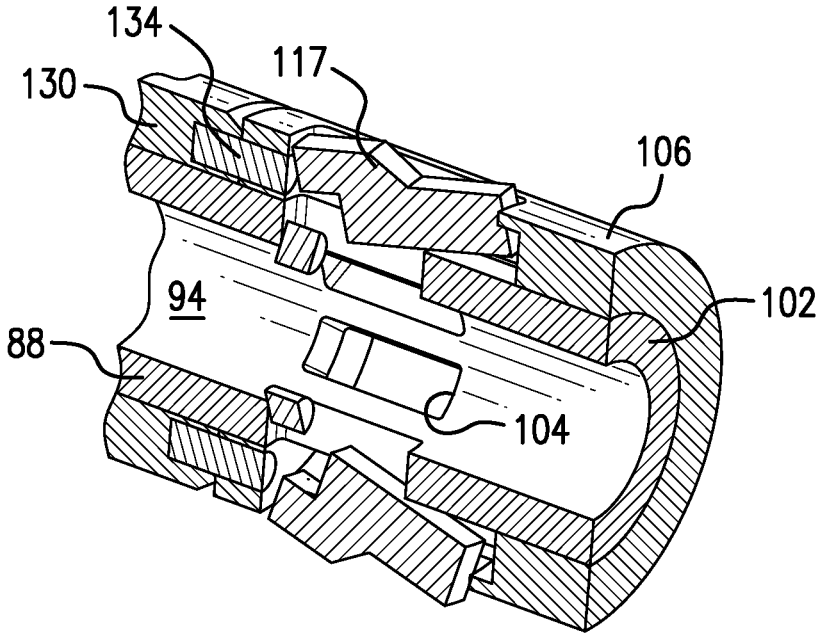
FIG. 5B depicts a partial cross-sectional view of the frac dart of FIG. 4B showing a counting system in a first position, in accordance with a non-limiting example.
Figure 5C:
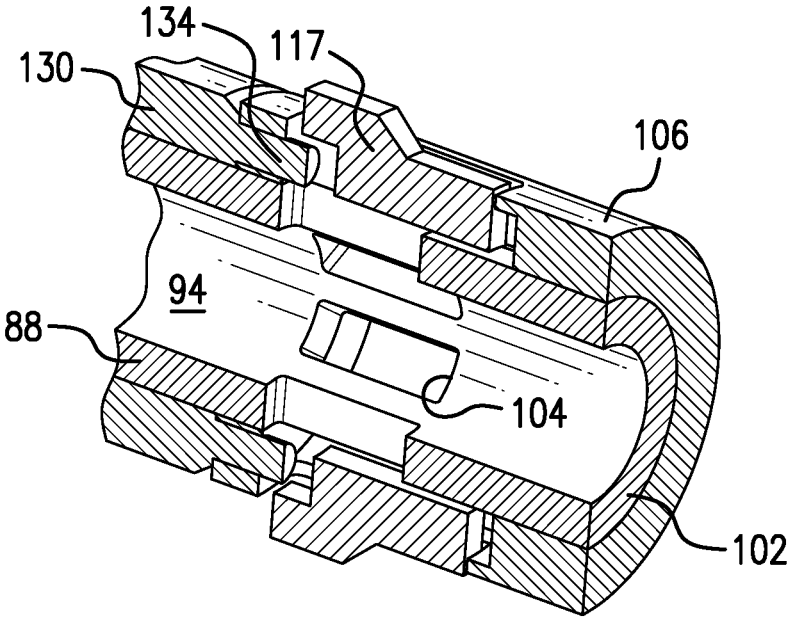
FIG. 5C depicts a partial cross-sectional view of the frac dart of FIG. 4C showing a counting system in a first position, in accordance with a non-limiting example.

In a non-limiting example, frac dart 48 is introduced into tubular string 30 at surface system 16. Frac dart 48 is pumped down with fluid pressure that acts on a wiper 141 that is provided on body 88. Wiper 141 is formed from an elastomeric material and thus may deform so as to engage inner surfaces of tubular string 30. Frac dart 48 approaches first frac sleeve 44*a* and cutters 114 engage restriction 70 as shown in FIGS. 4A and 5A. When in restriction 70, cutters 114 deflect radially inwardly removing a section of rod 134 as shown in FIGS. 4B and 5B. Once past restriction 70, cutters 114 defect back radially outwardly as shown in FIGS. 4C and 5C allowing rod 134 to advance toward second end 102. That is, fluid pressure acting on wiper 141 will urge rod support 130 along body 88 causing rod 134 to advance.

Figure 4D:
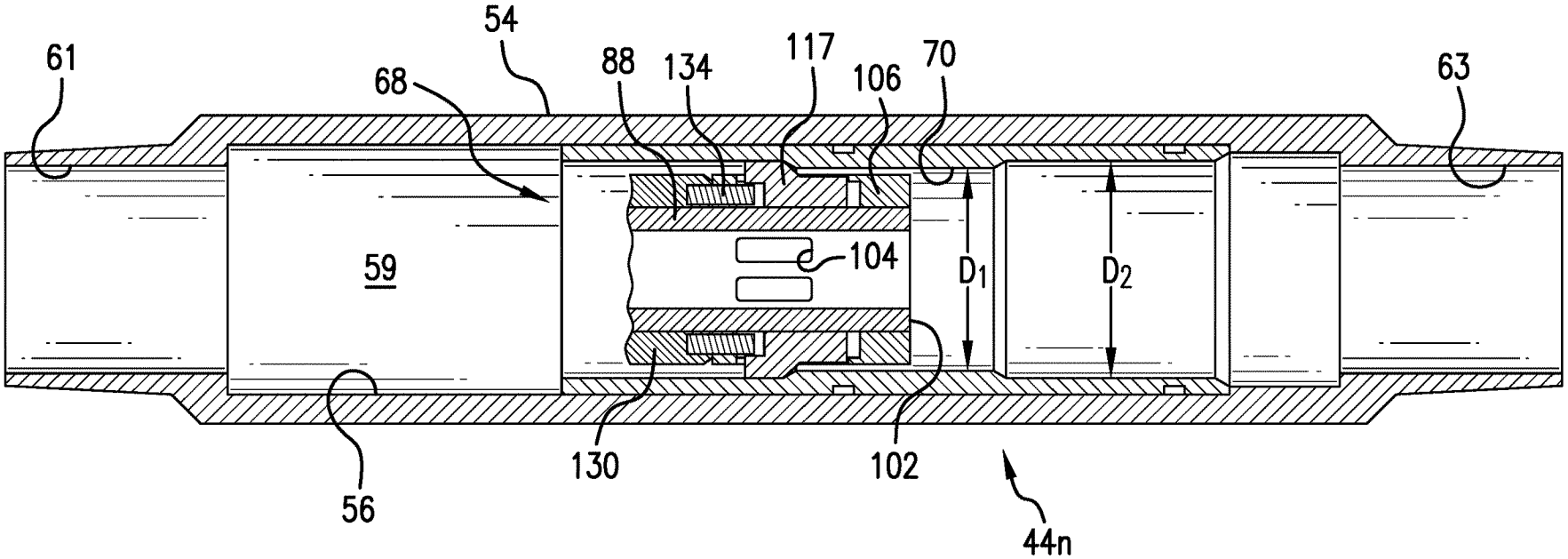
FIG. 4D depicts a cross-sectional view of the counting portion of the frac dart of FIG. 4C landing at a selected frac sleeve, in accordance with a non-limiting example.
Figure 5D:
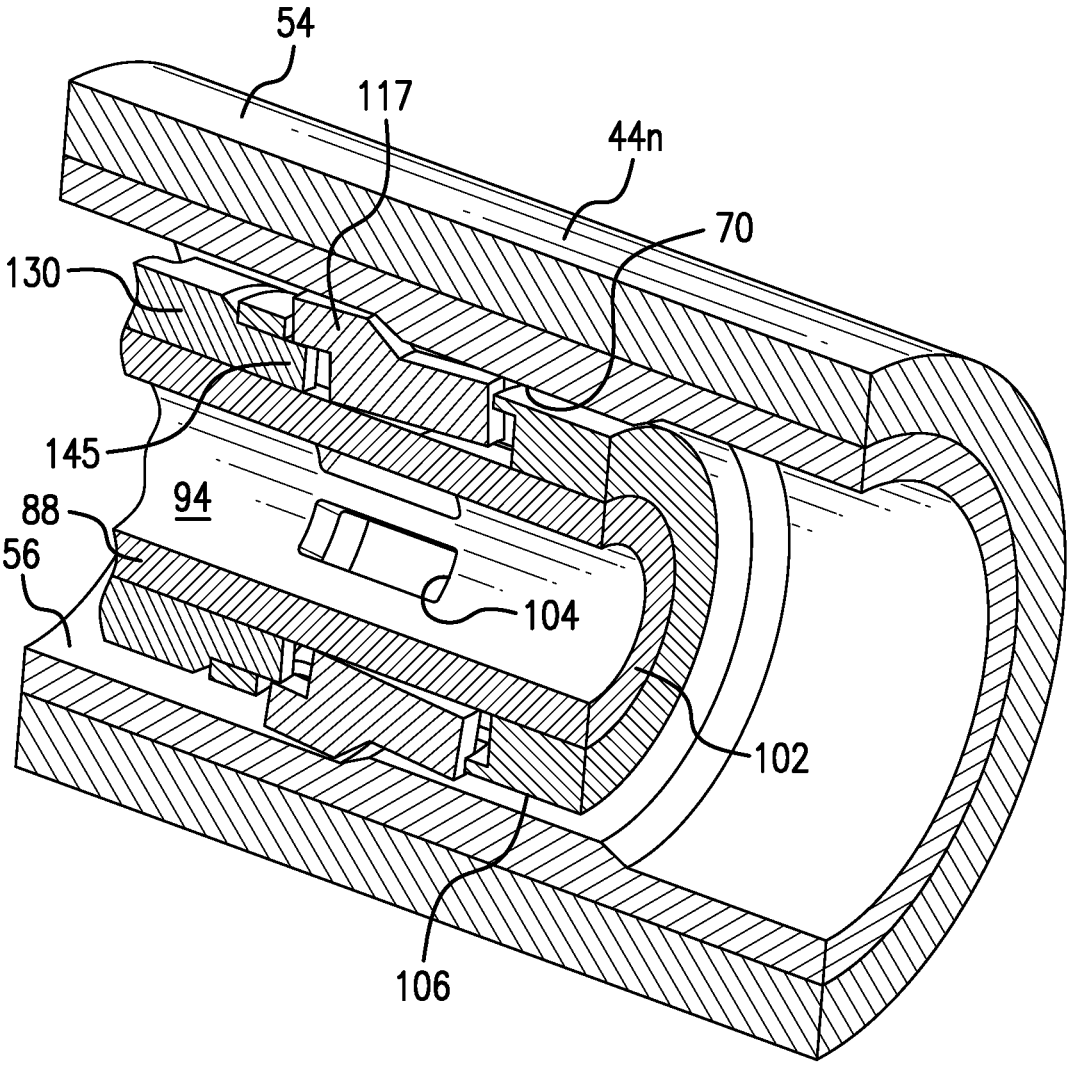
FIG. 5D depicts a partial cross-sectional view of the frac dart of FIG. 4D showing a counting system in a first position, in accordance with a non-limiting example.

Rod 134 will advance a select number of iterations which correspond to a select number of frac sleeves to be passed. Once consumed, frac dart 48 will land at the next frac sleeve 44*n* as shown in FIGS. 4D and 5D. As frac dart 48 approaches the selected frac sleeve 44*n*, cutter 114 is prevented from pivoting radially inwardly a sufficient amount that would allow passage. Instead, a cutter stop 145 or an axial end portion of rod support 130 blocks cutters 114. At this point, frac dart 148 forms an obstruction in tubular string 30.

At this point, it should be understood that the non-limiting examples, allow operators to employ frac sleeves that are all the same. In this manner, installing frac sleeves in an incorrect order is eliminated. Allowing the frac dart to count each sleeve and only land on the selected sleeve, together with the uniformity of the frac sleeves themselves reduces rig time. Further, frac darts 48 may be all or in part formed from a frangible material that can dissolve, be broken, drilled out, or fractured through various known methods.

Set forth below are some embodiments of the foregoing disclosure:

Embodiment 1. A frac dart comprising: a body having an outer surface and an end including at least one opening; a cutter support mounted at the end adjacent the at least one opening; a cutter moveably mounted at the cutter support; a counter support slideably mounted on the outer surface; and a counter arranged between the counter support and the cutter support, the cutter being operable to sever a portion of the counter.

Embodiment 2. The frac dart according to any prior embodiment, further comprising a wiper mounted to the body.

Embodiment 3. The frac dart according to any prior embodiment, wherein the wiper is formed from an elastomeric material.

Embodiment 4. The frac dart according to any prior embodiment, further comprising: a biasing element arranged between the cutter and the body, the biasing element shifting the cutter outwardly of the body.

Embodiment 5. The frac dart according to any prior embodiment, wherein the cutter support includes a cutter opening that registers with the at least one opening in the body.

Embodiment 6. The frac dart according to any prior embodiment, wherein the cutter includes a first portion that is pivotally mounted to the cutter support in the cutter opening and a second portion that selectively extends through the cutter opening.

Embodiment 7. The frac dart according to any prior embodiment, wherein the rod support includes a cutter stop that is selectively exposed to the cutter after the counter has been consumed.

Embodiment 8. A resource exploration and recovery system comprising: a surface system; a sub-surface system including a tubular extending into a formation, the tubular including a plurality of frac sleeves; and a frac dart that may selectively pass through one or more of the plurality of frac sleeves, the frac dart comprising: a body having an outer surface and an end including at least one opening; a cutter support mounted at the end at the at least one opening; a cutter moveably mounted at the cutter support; a counter support slideably mounted on the outer surface; and a counter arranged between the counter support and the cutter support, the cutter being operable to sever a portion of the counter.

Embodiment 9. The resource exploration and recovery system according to any prior embodiment, further comprising a wiper mounted to the body.

Embodiment 10. The resource exploration and recovery system according to any prior embodiment, further comprising: a biasing element arranged between the cutter and the body, the biasing element shifting the cutter outwardly of the body.

Embodiment 11. The resource exploration and recovery system according to any prior embodiment, wherein the cutter support includes a cutter opening that registers with the opening in the body.

Embodiment 12. The resource exploration and recovery system according to any prior embodiment, wherein the cutter includes a first portion that is pivotally mounted to the cutter support in the cutter opening and a second portion that selectively extends through the cutter opening.

Embodiment 13. The resource exploration and recovery system according to any prior embodiment, wherein the counter support includes a cutter stop that is selectively exposed to the cutter after the counter has been consumed.

Embodiment 14. The resource exploration and recovery system according to any prior embodiment, wherein each of the plurality of frac sleeves includes a restriction.

Embodiment 15. The resource exploration and recovery system according to any prior embodiment, wherein the restriction in each of the plurality of frac sleeves includes a substantially similar diameter.

Embodiment 16. A method of introducing a frac dart having a sleeve counting system into a tubular comprising: dropping the frac dart into the tubular; counting, with the sleeve counting system, each time the frac dart passes through a frac sleeve for a selected number of frac sleeves; and preventing the frac dart from passing through a selected frac sleeve immediately after the selected number of frac sleeves.

Embodiment 17. The method according to any prior embodiment, wherein counting each time the frac dart passes through the frac sleeve includes cutting off a portion of a counter.

Embodiment 18. The method according to any prior embodiment, further comprising: advancing the counter after passing through one of a selected number of sleeves.

Embodiment 19. The method according to any prior embodiment, wherein cutting off the portion of the counter includes moving a cutter with a restriction in the frac sleeve.

Embodiment 20. The method according to any prior embodiment, further comprising: blocking movement of the cutter after the frac dart passes through the selected number of sleeves to create an obstruction at the selected frac sleeve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac dart comprising:
- a body having an outer surface and an end including at least one opening;
- a cutter support mounted at the end adjacent the at least one opening;
- a cutter moveably mounted at the cutter support;
- a counter support slideably mounted on the outer surface; and
- a counter arranged between the counter support and the cutter support, the cutter being operable to sever a portion of the counter.

2. The frac dart according to claim 1, further comprising a wiper mounted to the body.

3. The frac dart according to claim 2, wherein the wiper is formed from an elastomeric material.

4. The frac dart according to claim 1, further comprising: a biasing element arranged between the cutter and the body, the biasing element shifting the cutter outwardly of the body.

5. The frac dart according to claim 1, wherein the cutter support includes a cutter opening that registers with the at least one opening in the body.

6. The frac dart according to claim 5, wherein the cutter includes a first portion that is pivotally mounted to the cutter support in the cutter opening and a second portion that selectively extends through the cutter opening.

7. The frac dart according to claim 1, wherein the cutter support includes a cutter stop that is selectively exposed to the cutter after the counter has been consumed.

8. A resource exploration and recovery system comprising:
- a surface system;
- a sub-surface system including a tubular extending into a formation, the tubular including a plurality of frac sleeves; and
- a frac dart that may selectively pass through one or more of the plurality of frac sleeves, the frac dart comprising:
  - a body having an outer surface and an end including at least one opening;
  - a cutter support mounted at the end at the at least one opening;
  - a cutter moveably mounted at the cutter support;
  - a counter support slideably mounted on the outer surface; and a counter arranged between the counter support and the cutter support, the cutter being operable to sever a portion of the counter.

9. The resource exploration and recovery system according to claim 8, further comprising a wiper mounted to the body.

10. The resource exploration and recovery system according to claim 8, further comprising: a biasing element arranged between the cutter and the body, the biasing element shifting the cutter outwardly of the body.

11. The resource exploration and recovery system according to claim 8, wherein the cutter support includes a cutter opening that registers with the opening in the body.

12. The resource exploration and recovery system according to claim 11, wherein the cutter includes a first portion that is pivotally mounted to the cutter support in the cutter opening and a second portion that selectively extends through the cutter opening.

13. The resource exploration and recovery system according to claim 8, wherein the counter support includes a cutter stop that is selectively exposed to the cutter after the counter has been consumed.

14. The resource exploration and recovery system according to claim 8, wherein each of the plurality of frac sleeves includes a restriction.

15. The resource exploration and recovery system according to claim 14, wherein the restriction in each of the plurality of frac sleeves includes a substantially similar diameter.

16. A method of introducing a frac dart having a sleeve counting system into a tubular comprising:

dropping the frac dart into the tubular;

counting, with the sleeve counting system, each time the frac dart passes through a frac sleeve for a selected number of frac sleeves by cutting off a portion of a counter; and preventing the frac dart from passing through a selected frac sleeve immediately after the selected number of frac sleeves.

17. The method of claim 16, further comprising: advancing the counter after passing through one of a selected number of sleeves.

18. The method of claim 16, wherein cutting off the portion of the counter includes moving a cutter with a restriction in the frac sleeve.

19. The method of claim 18, further comprising: blocking movement of the cutter after the frac dart passes through the selected number of sleeves to create an obstruction at the selected frac sleeve.

* * * * *